US008202396B2

(12) United States Patent
Hultcrantz et al.

(10) Patent No.: US 8,202,396 B2
(45) Date of Patent: Jun. 19, 2012

(54) STRUCTURAL CLOTHING AND METHOD OF MANUFACTURING A TISSUE PAPER WEB

(75) Inventors: Magnus Hultcrantz, Deje (SE); Ingvar Klerelid, Karlstad (SE); Bo-Christer Aberg, Halmalad (SE); Cary P. Johnson, Clifton Park, NY (US); John J. Lafond, Appleton, WI (US)

(73) Assignee: Albany International Corp., Albany, NY (US)

( * ) Notice: Subject to any disclaimer, the term of this patent is extended or adjusted under 35 U.S.C. 154(b) by 216 days.

(21) Appl. No.: 12/743,941

(22) PCT Filed: Nov. 14, 2008

(86) PCT No.: PCT/SE2008/000641

§ 371 (c)(1),
(2), (4) Date: May 20, 2010

(87) PCT Pub. No.: WO2009/067066

PCT Pub. Date: May 28, 2009

(65) Prior Publication Data

US 2011/0088859 A1 Apr. 21, 2011

(30) Foreign Application Priority Data

Nov. 20, 2007 (SE) ..... 0702543

(51) Int. Cl.
*D21F 11/00* (2006.01)

(52) U.S. Cl. ..... 162/116

(58) Field of Classification Search ..... 162/116, 162/111, 348, 361, 362, 902, 903
See application file for complete search history.

(56) References Cited

U.S. PATENT DOCUMENTS 4,239,065 A 12/1980 Trokhan (Continued)

FOREIGN PATENT DOCUMENTS

EP 0 526 592 B 4/1995

(Continued)

OTHER PUBLICATIONS

Supplementary European Search Report completed Dec. 7, 2010, issued in corresponding European Application No. EP 08 85 2745.

*Primary Examiner* — Mark Halpern
(74) *Attorney, Agent, or Firm* — Frommer Lawrence & Haug LLP; Ronald R. Santucci; Vivek P. Shankam

(57) ABSTRACT

A clothing for structuring a wet fibre web (1') in a press section of a tissue papermaking machine is described which has a three-dimensional woven structure forming elevations (62) and depressions (63), said elevations, like the depressions, are repeated and distributed to form a pattern of polygonal, geometrically similar smallest unitary surfaces (64), each of said unitary surfaces having an area a and covering a plurality of depressions with the mean depth d. According to the invention, the area a and the mean depth d of each unitary surface (64) are adapted in relation to each other in such a way that, calculated by the length unit mm, their ratio is equal to or greater than 30 mm, wherein a is selected within the range of 1.0-3.0 $mm^2$ and d is selected within the range of 0.03-0.09 mm. The invention also relates to a method for manufacturing a creped tissue paper web by using said structuring clothing.

37 Claims, 12 Drawing Sheets

U.S. PATENT DOCUMENTS

| | | | |
|---|---|---|---|
| 5,230,776 | A | 7/1993 | Andersson et al. |
| 5,393,384 | A | 2/1995 | Steiner et al. |
| 5,456,293 | A | 10/1995 | Ostermayer et al. |
| 5,861,082 | A | 1/1999 | Ampulski et al. |
| 6,547,924 | B2 | 4/2003 | Klerelid et al. |
| 6,743,339 | B1 | 6/2004 | Nilsson et al. |
| 7,166,196 | B1 | 1/2007 | Kramer et al. |
| 2002/0062936 | A1 | 5/2002 | Klerelid et al. |
| 2004/0144515 | A1 | 7/2004 | Danzler |
| 2008/0110591 | A1 | 5/2008 | Mullally et al. |

FOREIGN PATENT DOCUMENTS

| | | | |
|---|---|---|---|
| EP | 1 036 880 | A | 9/2000 |
| EP | 1 040 223 | B | 2/2003 |
| EP | 1 075 567 | B | 8/2003 |
| EP | 1 078 126 | B | 8/2005 |
| EP | 1 916 332 | A1 | 4/2008 |

STRUCTURAL CLOTHING AND METHOD OF MANUFACTURING A TISSUE PAPER WEB

This application is a 371 of PCT/SE2008/000641 filed on Nov. 14, 2008, published on May 28, 2009 under publication number WO 2009/067066 A and claims priority benefits of Swedish Patent Application No. 0702543-0 filed Nov. 20, 2007, the disclosure of which is incorporated herein by reference.

The present invention relates to a structuring clothing for structuring a wet fibre web in a press process in a press section of a tissue papermaking machine, said structuring clothing comprising a carrying layer and a structured layer which contacts the fibre web and is supported by the carrying layer, said structured layer having a three-dimensional woven structure comprising longitudinal and transverse threads plaited into each other and forming elevations and depressions which are defined by the elevations, said elevations, like the depressions, are repeated and distributed in the longitudinal and transverse directions of the structuring clothing to form a pattern of polygonal, geometrically identical smallest unitary surfaces which are located adjacent each other and have common boundary lines, each of said smallest unitary surfaces having an area a and covering a plurality of depressions with the mean depth $\bar{d}$, wherein the position and the alignment of each smallest unitary surface are defined by the fact that the corners thereof are coinciding with elevations which are displaced in relation to each other and formed by four consecutive longitudinal threads.

The invention relates also to a method of manufacturing a creped tissue paper web with high bulk in a tissue papermaking machine, said method comprising

- forming a fibre web in a wet section which comprises a headbox, a forming roll and a first clothing running about and in contact with the forming roll,
- pressing the formed fibre web in a press section which comprises a main press comprising a first press element, a second press element, said press elements defining a press nip therebetween with a predetermined pressure, a first clothing in form of a press felt running in an endless loop around a plurality of guide rolls and through said press nip together and in contact with the formed fibre web, the second press element being disposed within the loop of the press felt, a second clothing running in an endless loop around a plurality of guide rolls and through said press nip together and in contact with the formed fibre web, the first press element being disposed within the loop of the second clothing, and a transfer roll disposed within the loop of the second clothing,
- drying the structured fibre web in a drying section comprising a drying surface, and
- creping the dried fibre web from the drying surface with a creping doctor so that a creped tissue paper web is taken off from the drying surface, said transfer roll being arranged to define together with the drying surface a transfer nip for transferring the structured fibre web to the drying surface without compression in the transfer nip.

The expression "structuring" in the present invention means that a three-dimensional pattern of a structuring clothing is embossed into the wet fibre web during a pressing process when the dryness of the fibre web increases, and the fibres in the wet fibre web are movable in relation to each other so that in an advantageous manner they are brought to new positions and directions in relation to each other under the action of the elastic compressible press felt which presses the wet fibre web into the three-dimensional pattern of the structuring clothing. This all together contributes to an increased bulk at the same grammage and to higher MD and CD tensile strengths in the finished tissue paper web and improved structure thereof.

In manufacturing tissue paper in a conventional manner the formed wet fibre web is dewatered partly before the Yankee cylinder, usually either by a pressing technique or by a blowing technique known as TAD (through-air-drying). Conventional pressing technique for a press with a smooth press felt or a smooth press nip against the Yankee cylinder result in small thickness of the fibre web. It has been proposed to use shoe presses, i.e. extended press nips, which result in less pressure and less rewetting, to improve the quality, i.e. bulk, by increased thickness of the web. The aim has been to achieve the same high quality (bulk) or thickness as achieved with the TAD technique, however, this has hitherto not been found possible. The TAD technique is therefore still superior to the pressing technique with respect to paper web quality, however, it has the great disadvantage that an essentially higher energy consumption is required than is the case with a pressing technique.

U.S. Pat. No. 6,547,924 describes a papermaking machine of the kind defined in the preamble of claim 8. However, the papermaking machine described in said patent specification cannot simply produce tissue paper of sufficiently high quality to meet the requirements and wishes of the customers.

Additional examples of tissue papermaking machines equipped with embossing or structuring belts are EP 1 078 126, EP 0 526 592, U.S. Pat. No. 6,743,339, EP 1 075 567, EP 1 040 223, U.S. Pat. No. 5,393,384, EP 1 036 880 and U.S. Pat. No. 5,230,776.

After extensive test, the present inventors came to the understanding that the structure of the structuring clothing is of major and probably crucial significance for being able to achieve higher bulk in tissue paper than has hitherto been possible in a papermaking machine which uses the press technique, and that the structure of the structuring clothing can also be used as a parameter for controlling and achieving a high dryness in connection with the pressing in the press section where the structuring of the wet fibre web occurs.

The object of the invention is to enable the manufacturing of a tissue paper web of high bulk at a low energy cost. The invention therefore excludes said TAD technique for removal of water from the fibre web for the purpose of increasing the dryness.

This object is achieved according to the invention by the structuring clothing having the characteristic that the area a and the mean depth $\bar{d}$ of each smallest unitary surface of the structured layer are adapted in relation to each other in such a way that, calculated by the length unit mm, their $$\frac{a}{\bar{d}}$$

ratio is equal to or greater than 30 mm, wherein a is selected within the range of 1.0-3.0 $mm^2$ and $\bar{d}$ is selected within the range of 0.03-0.09 mm.

The method for manufacturing a tissue paper web according to the invention is characterised in that the pressing and structuring of the formed wet fibre web are carried out while using said second clothing which is in form of a structuring clothing to provide a three-dimensional, structured fibre web in the press step in the press nip, said structuring clothing having a carrying layer and a structured layer, which is to contact the fibre web and is supported by the carrying layer, said structured layer having a three-dimensional woven structure comprising longitudinal and transverse threads plaited into each other and forming elevations and depressions which are defined by the elevations, said elevations, like the depressions, are repeated and distributed in the longitudinal and transverse directions of the structuring clothing to form a pattern of polygonal, geometrically similar smallest unitary surfaces which are located adjacent each other and have common boundary lines, each of said smallest unitary surfaces having an area a and covering a plurality of depressions with the mean depth d, wherein the position and the alignment of each smallest unitary surface are defined by the fact that the corners thereof are coinciding with elevations which are displaced in relation to each other and formed by four consecutive longitudinal threads, wherein the area a and the mean depth d of each smallest unitary surface of the structured layer are adapted in relation to each other in such a way that, calculated by the length unit mm, their a/d ratio is equal to or greater than 30 mm, wherein a is selected within the range of 1.0-3.0 $mm^2$ and d is selected within the range of 0.03-0.09 mm.

Structuring clothing means primarily woven fabrics.

The invention is described further in the following with reference to the drawings.

FIG. 14 shows a structuring clothing according to a fourth embodiment of the invention.

FIG. 13 is a graphic representation showing the relationship between two magnitudes which can be measured and calculated for structuring clothings with pattern-forming smallest unitary surfaces in order to indicate whether a structuring clothing is usable in a method and in a tissue papermaking machine according to the present invention.

Figure 1:
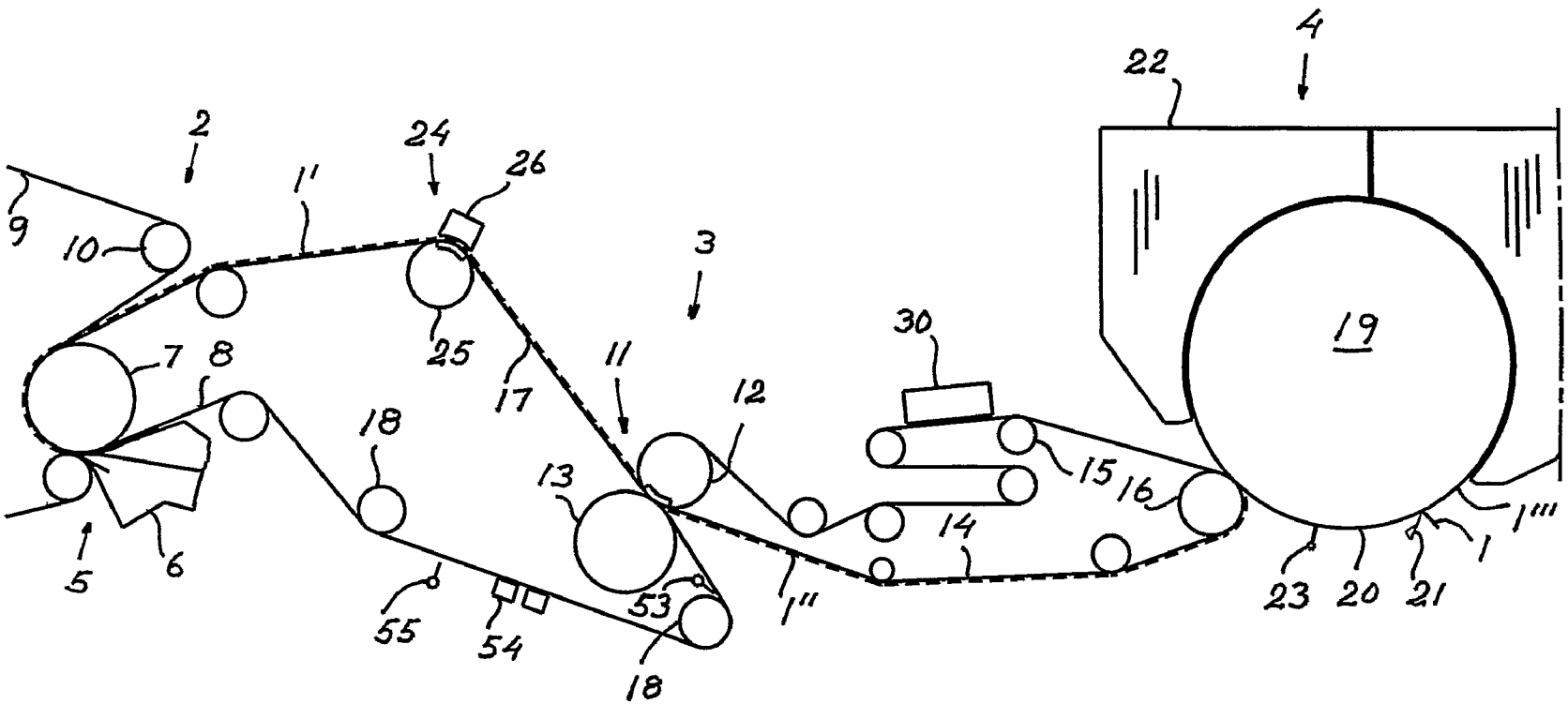
FIGS. 1 to 10 show ten different tissue papermaking machines with a structuring clothing according to the invention.

FIGS. 1-10 show schematically various embodiments of a tissue papermaking machine for manufacturing a tissue paper web 1 in accordance with the present invention without using through-air-drying (TAD) for drying the paper web. The various embodiments all comprise a wet section 2, a press section 3 and a drying section 4. The wet section 2 of each tissue papermaking machine according to the embodiments shown comprises a forming section 5 comprising a headbox 6, a forming roll 7 and a first forming clothing 8 which runs about and in contact with the forming roll 7. In the embodiments according to FIGS. 1 to 8, the forming section 5 also has a second forming clothing 9 that is a woven fabric which runs in an endless loop about a plurality of guide rolls 10 and about the forming roll 7 in contact with the first forming clothing 8 in order to receive between itself and the first clothing a jet of stock from the headbox 6. The stock is then dewatered for obtaining a formed fibre web 1'.

The press section 3 comprises a main press 11 comprising a first press element 12 and a second press element 13 which cooperate with each other to define a press nip therebetween. The press section 3 further comprises first and second clothings, the second clothing of which being in form of a structuring clothing 14 which runs in an endless loop about a plurality of guide rolls 15, about a smooth transfer roll 16 located adjacent to the drying section 4, and through the press nip of the main press 11 together and in contact with the formed fibre web 1' in order to provide a structuring of the formed fibre web 1' when the fibre web 1' passes through the press nip, so that a structured fibre web 1" will leave the press nip. The structured fibre web 1" is carried by the structuring clothing 14 up to the transfer nip between the transfer roll 16 and the drying cylinder 19, in which nip no pressing or dewatering occurs but merely a transfer of the fibre web 1" to the surface of the drying cylinder 19. Said first clothing of the press section 3 is in form of a water-receiving press felt 17 which in the z direction is elastically formable and compressible and runs in an endless loop about a plurality of guide rolls 18 and through the press nip of the main press 11 together with the structuring clothing 14 and in contact with the formed fibre web 1'. The first press element 12 is located in the loop of the structuring clothing 14, and the second press element 13 is located in the loop of the second press felt 17. In the embodiments shown in FIGS. 1-10, both of the press elements 12, 13 are press rolls. The press felt 17 separates from the structured fibre web 1" immediately after it has passed through the press nip, to prevent rewetting of the fibre web 1". One of the press elements 12, 13 can be designed as a press roll of a press having an extended or long nip press including but not limited to shoe press roll which can be arranged in an upper or lower position of the press.

Immediately before the first guide roll 18 after the main press 11, there is a spray device 53 disposed on the inside of the press felt 17 to supply fresh water into the wedge-shaped narrowing space between the press felt 17 and the guide roll 18, said water being pressed into the press felt 17 and displaces the contaminated water, which is present in the press felt 17 after the pressing in the main press 11, through and out from the press felt 17 when the latter runs about the guide roll 18. Upstream of the following guide roll 18 there are suction boxes 54 disposed on the outside of the press felt to withdraw water out from the press felt. The high-pressure spray device cleans the surface of the press felt 17 without this being saturated with water.

After the structuring clothing 14 has left the transfer roll 16 and before it reaches the main press 11, the structuring clothing 14 passes a cleaning station 30 for cleaning the three-dimensional structuring layer of the structuring clothing.

The drying section 4 comprises a first drying cylinder 19 which in the embodiments shown is the only drying cylinder which advantageously is a Yankee drying cylinder. Alternatively, other types of drying sections can be used, e.g. one having more cylinders, or other drying sections known in papermaking industry. The drying cylinder 19, with which the transfer roll 16 defines a transfer nip, has a drying surface 20 for drying the structured fibre web 1". A creping doctor 21 is disposed at a downstream location of the drying surface 20 to crepe the dried fibre web 1" away from the drying surface 20 in order to obtain the tissue paper web 1, which is creped. Preferably but not necessarily, the drying cylinder 19 is covered by a hood 22. Said transfer roll 16 and drying cylinder 19 define between them a transfer nip. The structuring clothing 14 and the structured fibre web 1" run together through said transfer nip, but they leave the transfer nip separated from each other because the structured fibre web 1" adheres to and is transferred to the drying surface 20 of the drying cylinder 19. The pressure in the transfer nip that is defined by the roll 16 and the drying cylinder 19 is less than 1 MPa in order to transfer the web without compressing. In order to ensure that the fibre web 1" is adhered to the drying surface 20, a suitable adhesive agent is applied by a spray device 23 onto the drying surface 20 at a point between the creping doctor 21 and the transfer nip where the drying surface 20 is free from the paper web.

Figure 7:
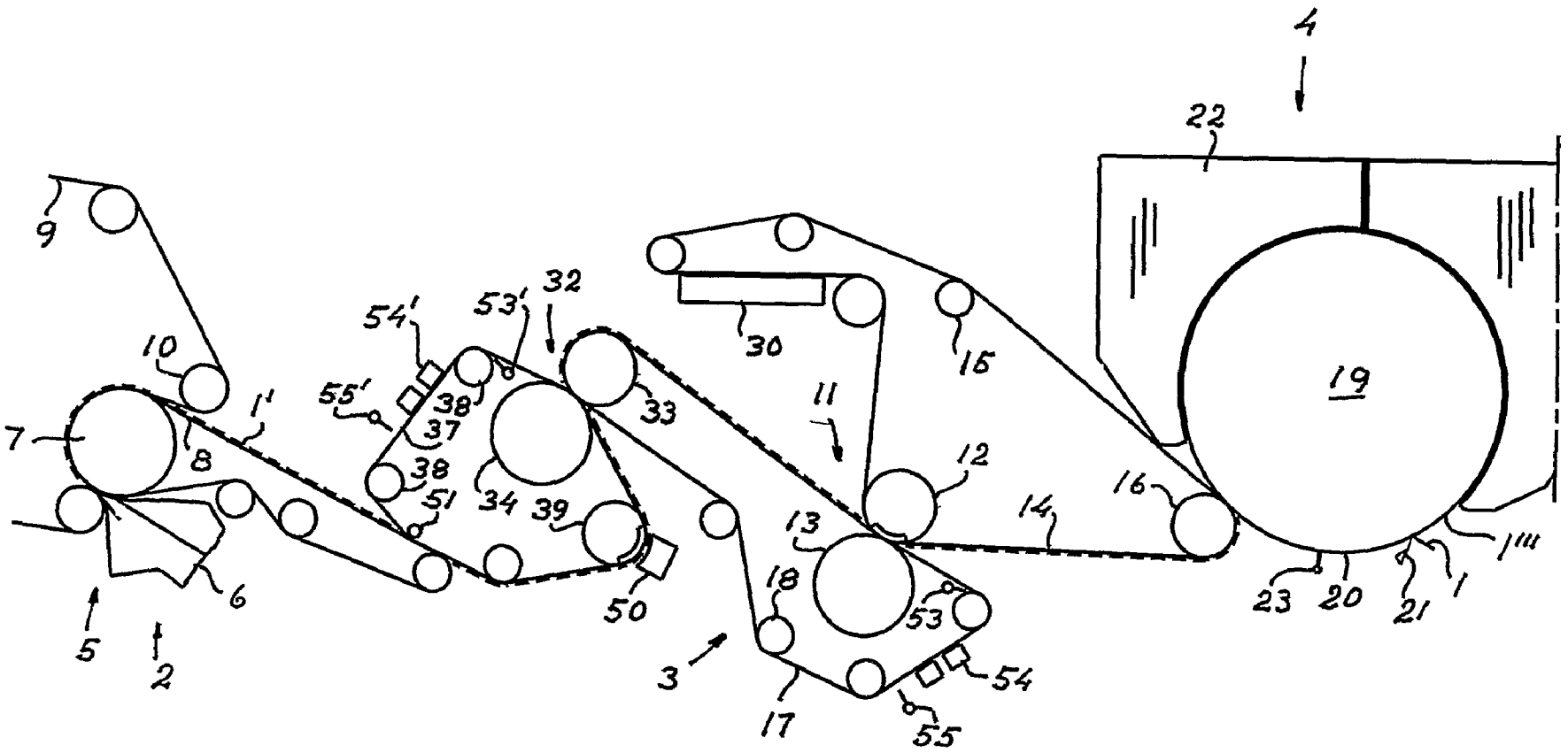
Figure 8:
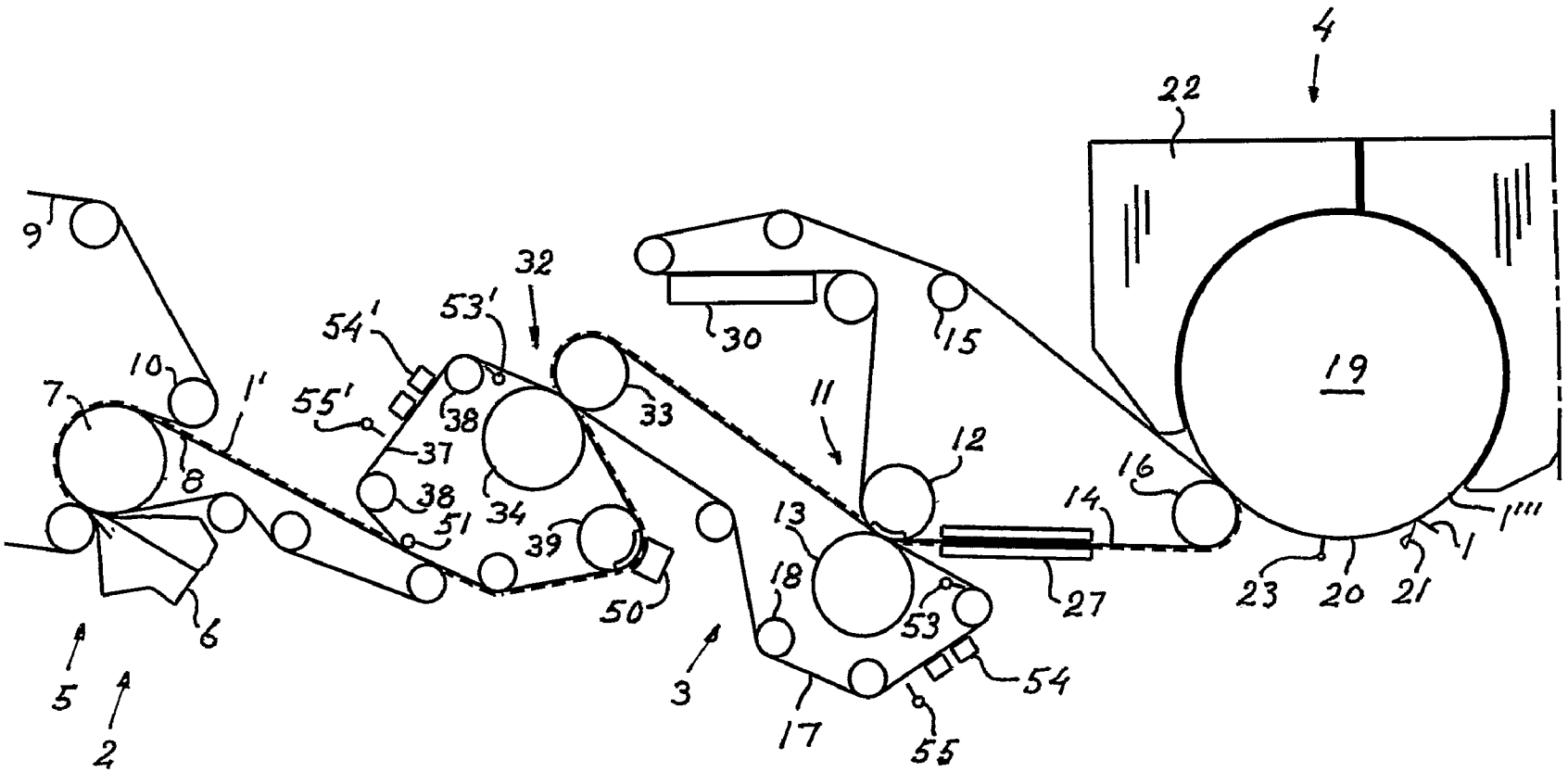
Figure 9:
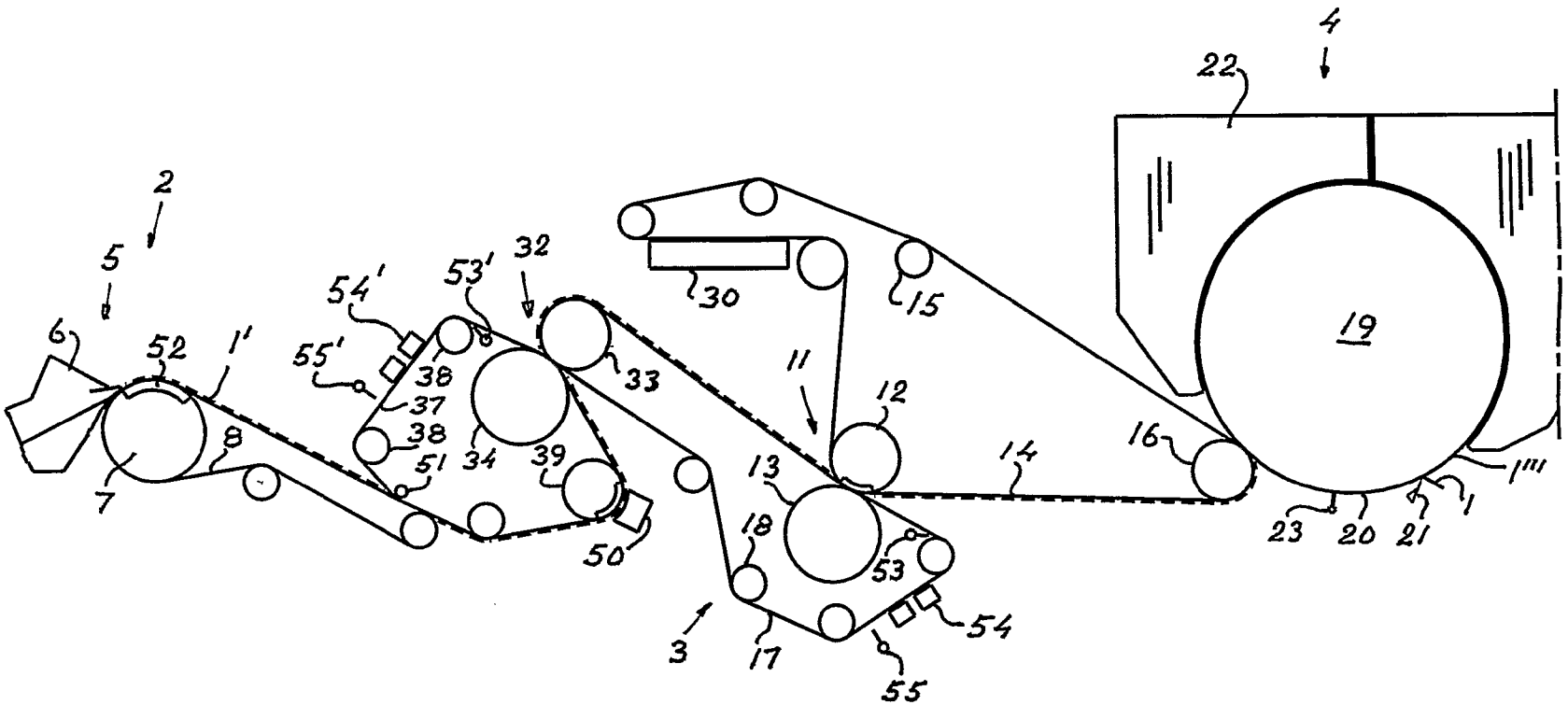
Figure 10:
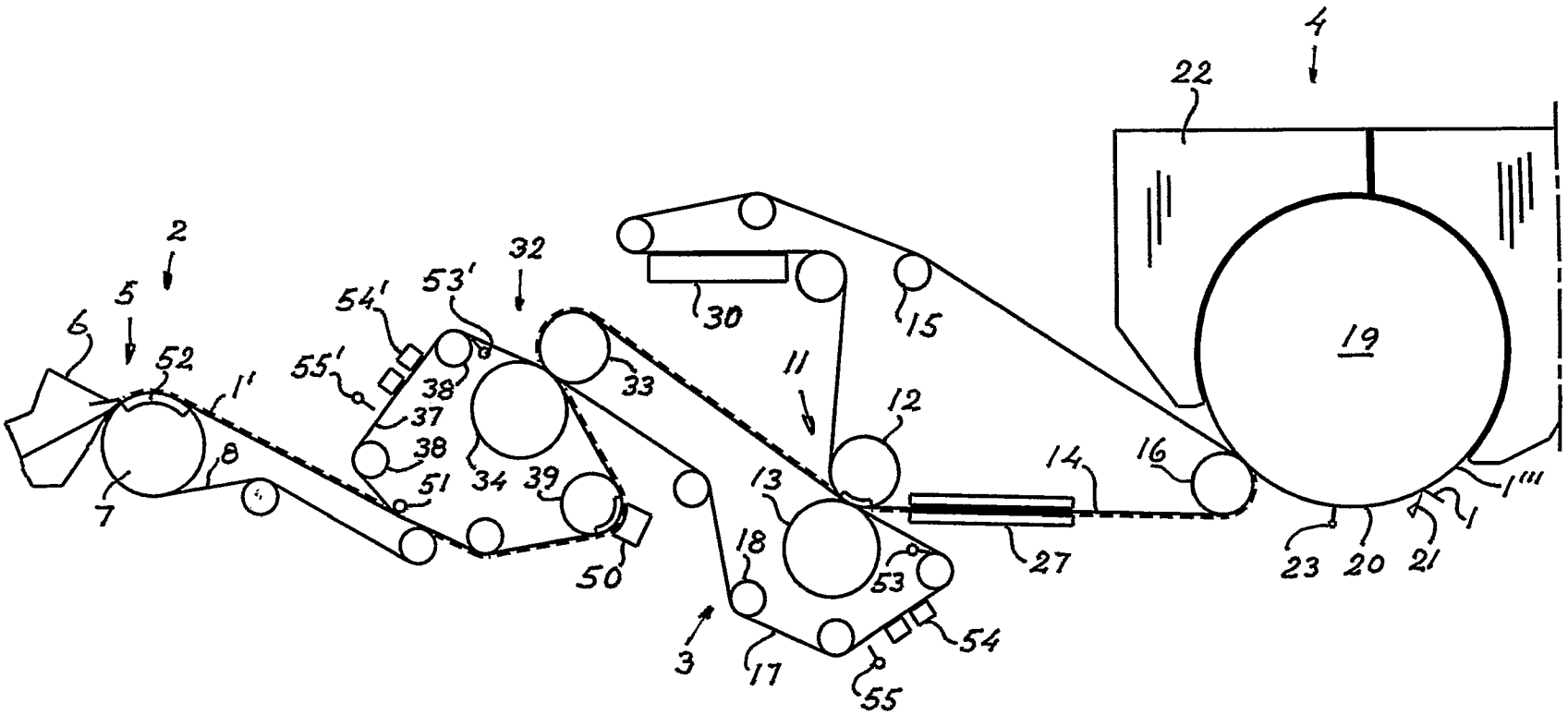

The forming section 5 may be a so-called C-former as shown in FIGS. 1, 2, 7 and 8 or a so-called Crescent former as shown in FIGS. 3 to 6 or a so-called suction breast roll former as shown in FIGS. 9 and 10.

The main press 11 may be a roll press in which the two press elements 12, 13 are rolls with smooth mantle surfaces, or, as preferred, a press with extended nip including a shoe press (not shown), wherein the first press element 12 is a smooth counter-roll and the second press element 13 comprises a press shoe and an endless belt which runs through the press nip of the shoe press in sliding contact with the press shoe, which exerts a predetermined pressure against the inside of the belt and against the counter-roll 12. Thus, the press shoe is a device which forms an extended press nip. In a further preferred embodiment of the main press 11, the first press element 12 is a smooth counter-roll and the second press element comprises a device for forming an extended press nip, said device comprising an elastic support body which is arranged to press in the direction towards the counter-roll. Alternatively, both of the press elements 12, 13 can each include an elastic support body. In an alternative embodiment, the press element 13 is a smooth counter-roll and the second press element 12 comprises a device which forms an extended nip of any one of the types mentioned above.

In the embodiment according to FIG. 1, the press felt 17 of the main press is also used as the inner first forming clothing 8 of the forming section 5 so that the forming roll 7 is also located within the loop of the press felt 17. In this case the wet section also comprises a predewatering device 24 comprising a suction roll 25 located within the loop of the press felt 17, and a steam box 26 located on the outside of the loop of the press felt 17 opposite the suction roll 25 for heating the water in the formed fibre web 1' in order to decrease the viscosity and promote the dewatering. By means of such a suction roll 25 and steam box 26 the amount of water in the formed fibre web 1' and in the press felt 17 is reduced so that the formed fibre web 1' obtains a desired increased dryness of 16-28% before the main press 11 which ensures the runability of the press. The following press provides a dryness of the web of 38-52% resulting in an energy saving in the dry section since the amount of water to be evaporated therein is reduced. A high-pressure spray device 55 is disposed on the outside of the forming felt 8 upstream of the forming roll 7 to clean the forming felt 8 so that the latter is not saturated with water when arriving at the forming roll 7.

Figure 2:
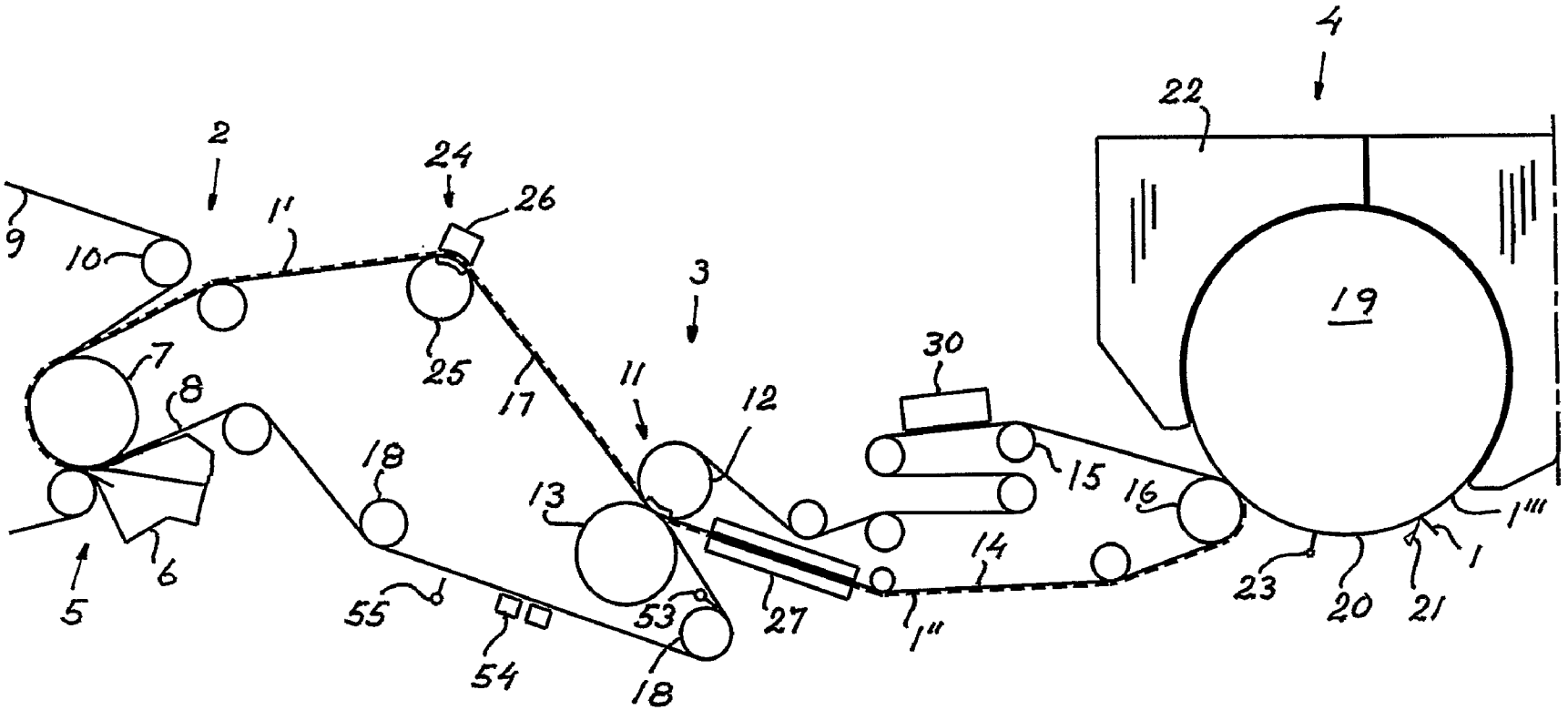

The embodiment according to FIG. 2 is similar to that in FIG. 1 with the exception that it comprises in addition a preheating device 27 downstream of the main press 11 to raise the temperature of the fibre web 1" before the fibre web 1" reaches the drying cylinder 19.

Figure 3:
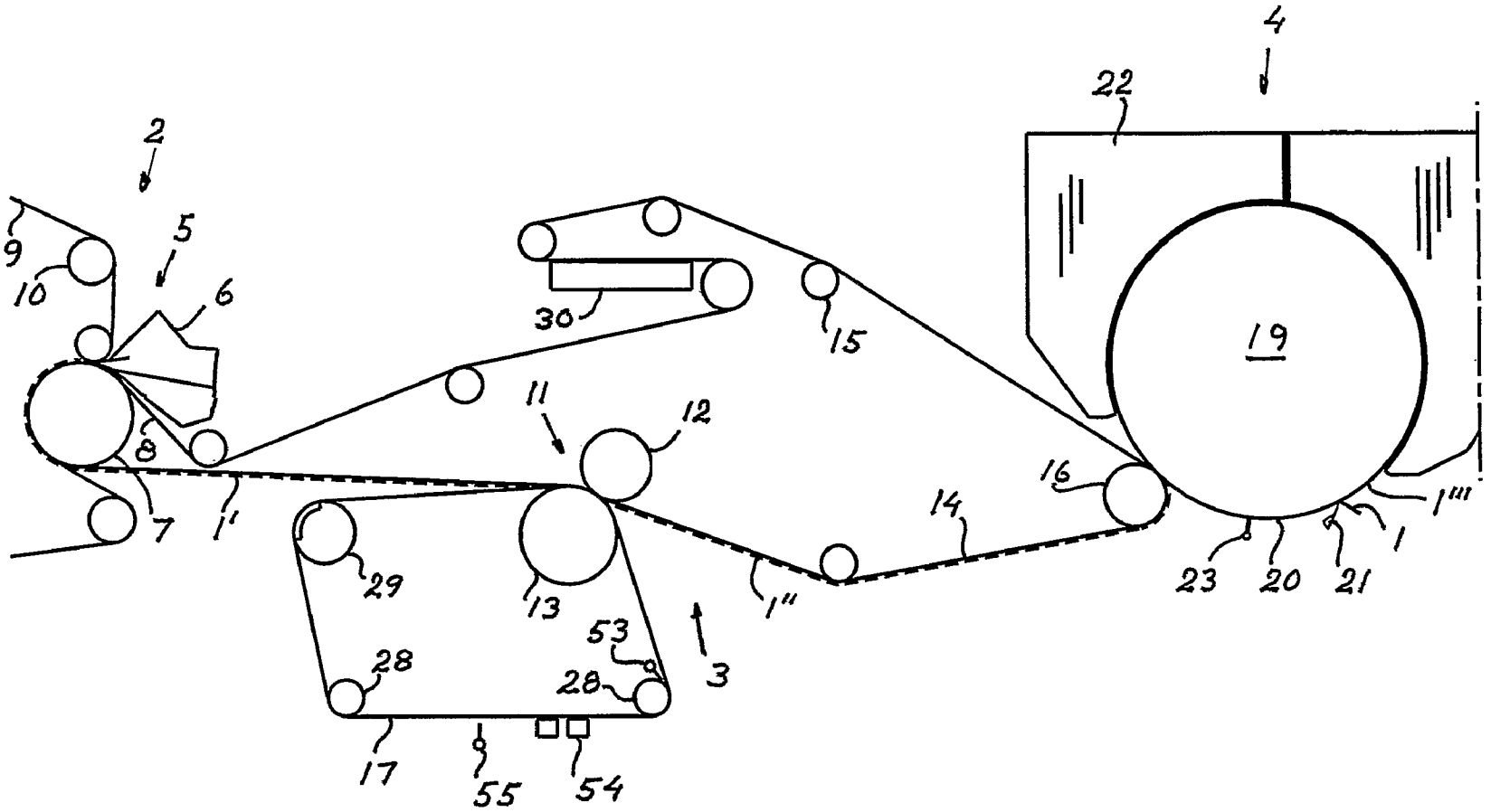

In the embodiment according to FIG. 3, the structuring clothing 14 is also utilized as the inner first forming clothing 8 of the forming section so that the forming roll 7 is also located within and enclosed by the loop of the structuring clothing 14. The dewatering occurs for the most part through the clothing 9. In this case the press felt 17 of the main press 11 runs in its own loop about a plurality of guide rolls 28 and the second press element 13. The guide roll located upstream of the second press element 13 is a suction roll 29 by which water is removed from the press felt 17 before the press felt 17 runs into the press in order to ensure the ability of the felt 17 to absorb water. A particular effect of this embodiment, in which the structuring clothing 14 also passes around the forming roll 7, is that it enables fibres of the stock to penetrate into and orientate themselves in the depressions of the structuring clothing 14 so that part of the formed fibre web is already oriented in the depressions before the pressing in the main press 11 commences. Such a preorientation of fibres in the depressions is therefore advantageous. Immediately before the first guide roll 28 after the main press 11, a spray device 53 is disposed on the inside of the press felt 17 to supply fresh water into the wedge-shaped narrowing space between the press felt 17 and the guide roll 28. This water is pressed into the press felt 17 and displaces the contaminated water which is present in the press felt 17 after the pressing in the main press 11 through and out from the press felt 17 when the latter runs around the guide roll 28. Upstream of the next guide roll 28 there are suction boxes 54 disposed on the outside of the press felt 17 to withdraw water out from the press felt 17, and a high-pressure spray device 55 which cleans the press felt 17.

Figure 4:
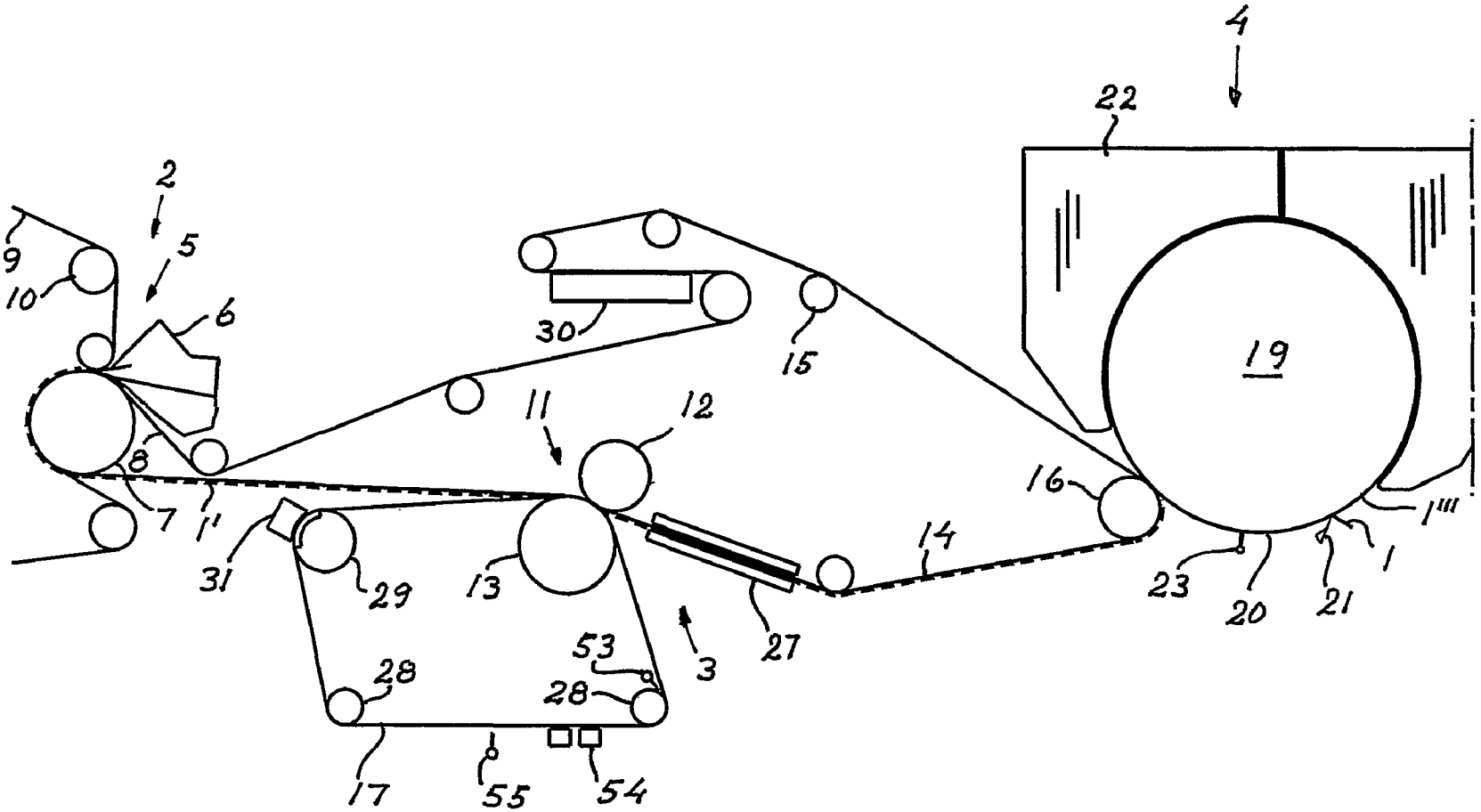

The embodiment according to FIG. 4 is similar to that in FIG. 3 with the exception that it is supplemented in addition with a preheating device 27 in accordance with the embodiment according to FIG. 2, and that a steam box 31 is disposed on the outside of the press felt 17 opposite the suction roll 29.

Figure 5:
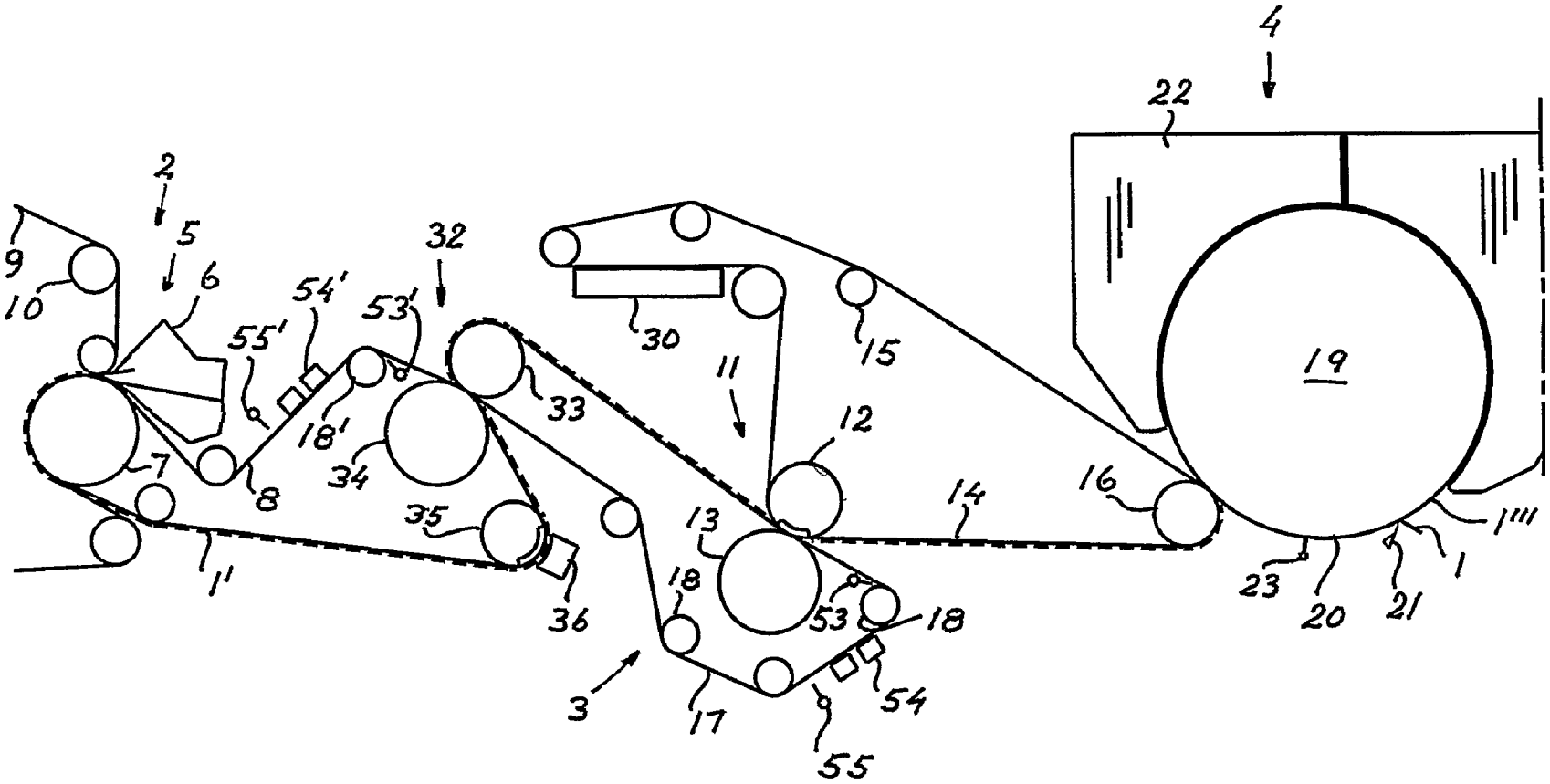

In the embodiment according to FIG. 5, the inner first forming clothing 8, the press felt 17 and the structuring clothing 14 have their own loops, the forming clothing 8 being a felt which runs around a plurality of guide rolls 18'. The press section 3 comprises in this case a pre-press 32 comprising a first press element 33 located within the loop of the press felt 17 and a second press element 34 located within the inner first forming felt 8, said press elements 33, 34 forming a press nip with each other through which the forming felt 8 carrying the fibre web 1' runs to meet the press felt 17, which also runs through the last-mentioned press nip in order to receive the formed fibre web 1' and carry it forward to the main press 11. The forming felt 8 thus also forms the second press felt of the pre-press 32. The guide roll located nearest upstream to the second press element 34 is a suction roll 35 by which water is removed from the forming felt 8. A steam box 36 is located on the outside of the forming felt 8 opposite the suction roll 35. Immediately before the first guide roll 18' after the pre-press 32, a spray device 53' is disposed on the inside of the forming felt 8 to supply fresh water into the wedge-shaped narrowing space between the forming felt 8 and the guide roll 18', said water being pressed into the forming felt 8 and displaces the contaminated water which is present in the forming felt 8 after the pressing in the pre-press 32 through and out from the forming felt 8 when the latter runs around the guide roll 18'. Upstream of the next guide roll 18' there are suction boxes 54' disposed on the outside of the forming felt 8 to withdraw water out from the forming felt 8, and a high-pressure spray device 55' which cleans the forming felt 8. The pre-press 32 can include a press with an extended nip including a shoe press.

Figure 6:
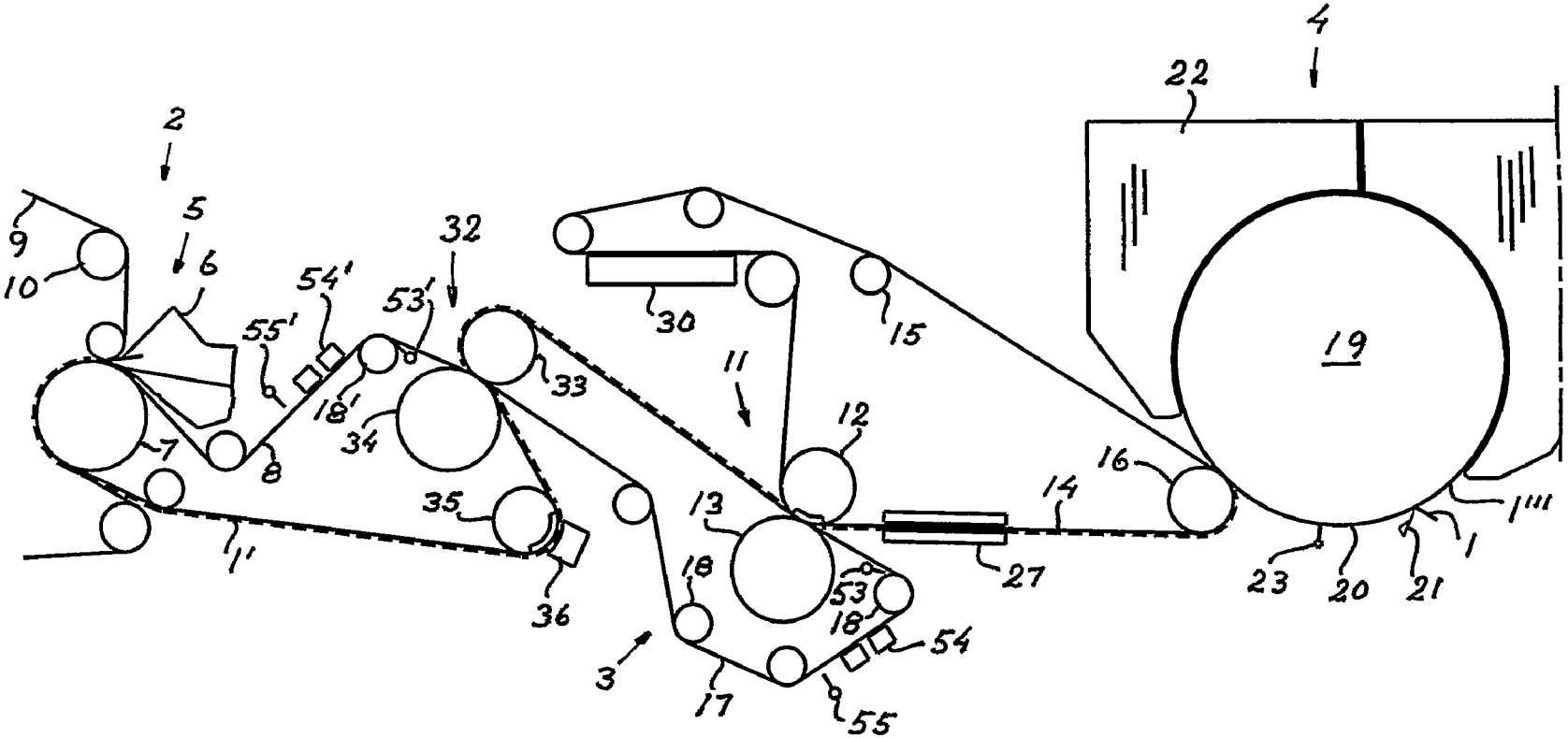

The embodiment according to FIG. 6 is similar to that in FIG. 5 with the exception that it comprises in addition a preheating device 27 in accordance with the embodiment shown in FIG. 2.

In the embodiment according to FIG. 7, the inner first forming clothing 8, which is a forming fabric, the press felt 17 and the structuring clothing 14 have their own loops similar to the embodiment according to FIG. 5. In this case the forming section 5 is thus a twin-wire C-former. The forming roll 7 may be a suction roll, if desired. Also in this case the press section 3 comprises a pre-press 32 comprising a first press element 33 located within the loop of the press felt 17, and a second press element 34 located within a second press felt 37 which runs in a loop around a plurality of guide rolls 38, the guide roll located nearest upstream to the second press element 34 being a suction roll 39 by which water is removed from the second press felt 37. A steam box 50 is disposed on the outside of the second press felt 37 opposite the suction roll 39. The second press felt 37 runs in contact with the inner first forming fabric 8 to form a transfer zone in which the press felt 37, the formed fibre web 1' and the forming fabric 8 form a sandwich structure. When the fibre web 1' leaves the transfer zone, it is carried by the second press felt 37. A suction device 51 may be disposed within the loop of the second press felt 37 in connection to the transfer zone in order to ensure that the fibre web 1' is transferred. Immediately before the first guide roll 38 after the pre-press 32, a spray device 53' is disposed on the inside of the press felt 37 to supply fresh water into the wedge-shaped narrowing space between the press felt 37 and the guide roll 38, said water being pressed into the press felt 37 and displaces the contaminated water which is present in the press felt 37 after the pressing in the pre-press 32 through and out from the press felt 37 when the latter runs around the guide roll 38. Upstream of the next guide roll 38 there are suction boxes 54' disposed on the outside of the press felt 37 to withdraw water out from the press felt 37, and a high-pressure spray device 55' which cleans the press felt 37 so that the latter is not saturated with water when arriving at the suction device 51. The pre-press 32 can include a press with an extended nip including a shoe press.

The embodiment according to FIG. 8 is similar to that in FIG. 7 with the exception that it is supplemented in addition with a preheating device 27 after the main press in accordance with the embodiment shown in FIG. 2.

The embodiment according to FIG. 9 is similar to that in FIG. 7 apart from the wet section, which has in this case a forming section of a different type from the previously mentioned C-former and Crescent former. The forming section according to FIG. 9 is a so-called suction breast roll former which comprises a headbox 6, a forming roll 7 which is a suction breast roll, and a forming clothing 8 which is a forming fabric running in a loop around the suction breast roll 7 and guide rolls and forms a transfer zone with the second press felt 37 in accordance with the embodiment shown in FIG. 7. The suction breast roll 7 has a suction zone 52 forming a forming zone above which the forming fabric 8 passes together with stock which is delivered in a jet from the headbox 6 and is dewatered within the forming zone 52 to form a formed fibre web 1'.

The embodiment according to FIG. 10 is similar to that in FIG. 9 with the exception that it is supplemented in addition with a preheating device 27 in accordance with the embodiment shown in FIG. 2.

The pre-press 32 which is included in the embodiments according to FIGS. 5 to 10 may be a press selected from the group of different presses described above with respect to the main press 11.

The structuring clothings 14 as mentioned for the tissue papermaking machines shown are impermeable. This means that neither liquid nor air can pass through them. Partly water permeable structuring clothings may also be used. This means that when pouring a liquid onto one side of the clothing the liquid will be forced therethrough and can be seen on the rear side of the clothing.

The structuring clothing 14 for structuring a wet fibre web 1' has a carrying layer 59 and a structured layer 60 which is supported by the carrying layer 59 and constitutes the forming side of the structuring clothing. The layer 60 has a web-contacting surface 61 of a three-dimensional structure formed by elevations 62 and depressions 63 which are defined by the elevations 62.

The elevations 62, like the depressions 63, are regularly recurrent and distributed in the longitudinal and trans-verse directions of the structuring clothing to form a pattern defined by tetragonal, geometrically similar, smallest unitary surfaces, i.e. unitary surfaces 64, which are located adjacent each other and have common boundary lines, said unitary surfaces 64 forming the repeating unitary basic pattern of the structuring clothing 14. The unitary surfaces 64 are thus imaginary and are located adjacent to and merge with each other without visible boundaries in the structure of the clothing. Each unitary surface 64 has an area, designated a. Each unitary surface 64 covers a plurality of depressions 63 which together form a pocket 65 with the volume v and the mean depth d. These unitary surfaces 64 and associated pockets 65 are utilized for measuring and calculating said magnitudes and hence determining the characteristics and usefulness in a tissue papermaking machine in order to make a fibre web with sufficiently high dryness before the drying section and a tissue paper with satisfactory structure/bulk and with other properties within the intervals which are shown below. It is understood that each such unitary surface 64 is planar (two-dimensional) and coincides with the plane of the structuring clothing which is tangent to the tops of the elevations.

To achieve optimum structure and dryness of the web it is important that the structuring clothing 14 allows the wet fibre web 1' can be formed into the depressions 63 or pockets 65 when the fibre web 1' passes through the press nip together with the press felt 17 and the structuring clothing 14 with the wet fibre web 1' enclosed therebetween. It is also important that during the pressing step the press felt 17 can reach down into all the depressions of the pockets 65 in order to build up a sufficiently high hydraulic pressure to enable water in the wet fibre web 1' to move into the press felt 17 and not remain in the fibre web at the end of the pressing step. The pockets 65 have to be large enough to allow the press felt 17 to reconfigure itself around the elevations 62 and penetrate into the pockets 65. Each pocket 65 has to have a largest depth which enables water in the bottom of the pocket 65 to be transported away. In other words, the depth of the pocket 65 must not be too large, since too large a depth would prevent the desired hydraulic pressure from being achieved. The mean depth of the pockets 65 is therefore defined by the elastic deformation ability of the press felt, i.e. the deeper the pockets 65 are the more elastic deformation of the press felt 17 is required in order to reach the bottom of the deepest depressions during the press step and vice versa. The shallower the pockets 65 are the less elasticity of the press felt 17 is required. On the other hand, when the pockets 65 are too small the three-dimensional structure of the clothing will be too low and as a result thereof the three-dimensional structure or bulk of the fibre web will be too low. When the pockets 65 are too deep the elastic deformation of the press felt 17 is not sufficient to reach the bottom of the pocket 65 in order to create the hydraulic pressure required, resulting in a decreased dewatering, i.e. reduced dryness, and deteriorated releasing properties resulting in web rupture. This explains the press and structuring process and the reason to the fact that the fibre web obtains a higher bulk than what is possible in conventional pressing.

The structuring clothing 14 with its specific well-defined, structured, web-contacting surface 61 is now an important parameter for controlling the structure and dryness level which may be expected in the structured fibre web 1" after the press nip before the final drying. It is of course a prerequisite that the pressure in the press nip is not too high but is within normal conventionally applied values for pressing and that the press felt 17 is of the conventional elastically compressible type which, in addition to its necessary water-receiving capacity, during the compression reconfigures itself elastically against the structured web-contacting surface with the wet fibre web located therebetween in the manner and for the purposes indicated above.

Figure 11:
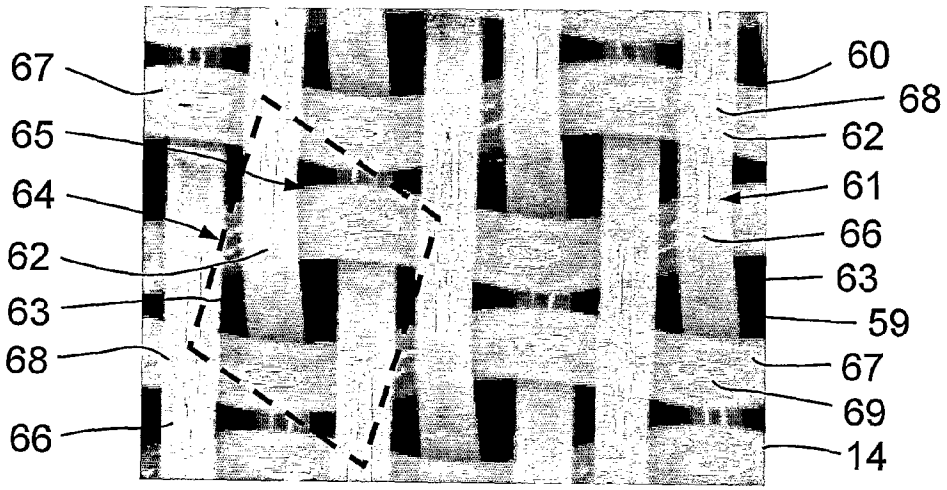
FIG. 11 shows a structuring clothing according to a first embodiment of the invention.
Figure 12:
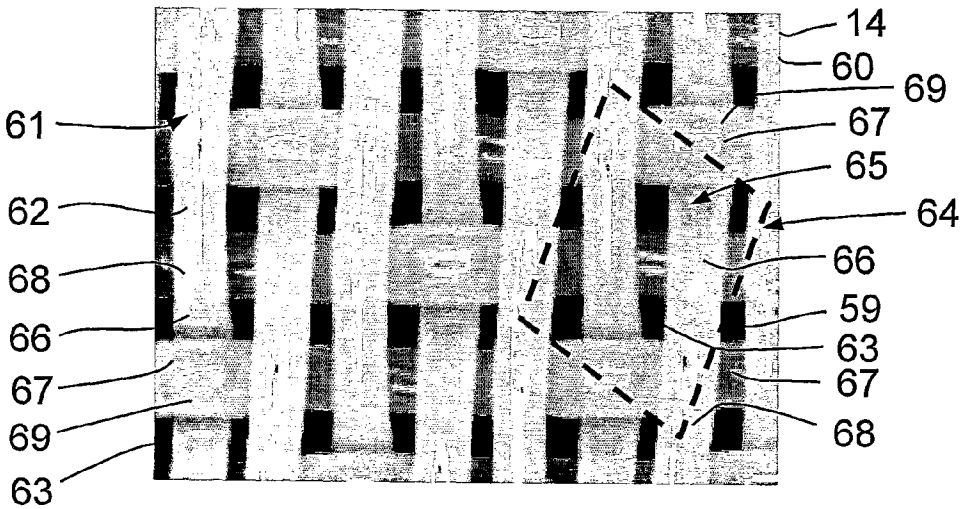
FIG. 12 shows a structuring clothing according to a second embodiment of the invention.

FIGS. 11 and 12 show preferred embodiments of a structuring clothing 14, said layer 60 of the structuring clothing which faces the forming side, comprising a network structure constituting the basis for said elevations 62 and depressions 63. The network structure takes the form in each case of a fabric made of plaited or woven threads 66, 67 of suitable material, e.g. metal or plastic (polyester/polyamide), for obtaining a mesh pattern. In FIG. 11, the mesh pattern is formed by extending each longitudinal thread 66 (in the machine direction) over three transverse threads 67 (cross to the machine direction) and thereafter under two transverse threads 67, with offsetting of two transverse threads in this plaiting process for the next longitudinal thread 66. In FIG. 12 the mesh pattern is formed by extending each longitudinal thread 66 over four transverse threads 67 and thereafter under one transverse thread 67 with offsetting of two transverse threads in this plaiting process for the next longitudinal thread 66. The surface of the fabric facing the fibre web is coated with a layer of a polymer which causes the surface of the fabric to maintain its structure. The thickness of the polymer layer is also a valuable control factor for regulating the volume of the depressions by building up the plastic layer by one or more steps of film coatings.

The plaited mesh pattern described gives the elevations 62 a knuckle-like shape at both the longitudinal and the transverse threads 66, 67, the knuckles 68 of the longitudinal threads being essentially longer than the knuckles 69 of the transverse threads. In FIG. 11, like FIG. 12, a polygonal, more precisely tetragonal, smallest unitary surface 64 is depicted, the position and orientation of which are determined by the fact that the corners of the tetragon coincide with the approximate midpoints of four neighbouring knuckles 68 of four successive longitudinal threads 66, said knuckles 68 being displaced in the longitudinal direction in relation to each other. In the cases shown, the unitary surfaces 64 are parallelograms. A unitary surface 64 shown in FIG. 11 can be read off, marked, depicted, etc., wherever so desired on the structuring clothing 14 at different points in the machine direction and the cross machine direction. The unitary surface 64 and its associated pocket 65, which is covered by the unitary surface, are utilized for measuring purposes. In order to achieve satisfactory measurement results while taking inevitable tolerances into account, smallest unitary surfaces 64 and their pockets 65 are measured at a plurality of places selected at random along and across the structuring clothing 14 in order to calculate mean values of all measured values divided with the number of measuring places.

The carrying layer 59 of the structuring clothing may be impermeable or permeable.

Tests

Four different structuring clothings, hereinafter denoted structuring belts, were investigated with respect to the size of the smallest unitary surface 64 and the volume of the associated pocket 65 of each belt. The structuring belts chosen were denoted Belt A, Belt C, Belt D and Belt E. Belt A, Belt D and Belt E had a thread structure according to FIG. 11, and Belt C a thread structure according to FIG. 12. The measurements were done with a measuring device of the type MarSurf WS1 from Carl Mahr Holding GmbH, Carl-Mahr-Strasse 1, D-37073, Germany, said measuring device enabling rapid three-dimensional contact-free measurement with a vertical resolution of 0.1 nm. The measurements were done in each case at five different locations of unitary surfaces 64 in order to calculate a mean value while taking tolerances in the manufacturing of the belts in consideration. The measured values were used to calculate the ratio of the volume v and the area a in order to obtain a length value expressed in mm designated as d which is a mean value of the depth of all depressions 63 of the pocket 65, the bottom surface of which was highly uneven. The measured values of volume v and area a and the ratios calculated therefrom are shown in Table 1 below.

TABLE 1

| | Volume $mm^3$ v | Area $mm^2$ a | Volume/Area Mean depth d mm |
|---|---|---|---|
| Belt A | 0.15685 | 1.7442 | 0.090 |
| | 0.152879 | 1.721 | 0.089 |
| | 0.15527 | 1.7453 | 0.089 |
| | 0.15278 | 1.71874 | 0.089 |
| | 0.15823 | 1.79305 | 0.088 |
| Mean value | 0.155 | 1.74 | 0.089 |
| Belt C | 0.18945 | 2.6596 | 0.071 |
| | 0.18318 | 2.63073 | 0.070 |
| | 0.18004 | 2.6349 | 0.068 |
| | 0.1813 | 2.64427 | 0.069 |
| | 0.18317 | 2.6117 | 0.070 |
| Mean value | 0.183 | 2.64 | 0.070 |
| Belt D | 0.08571 | 1.4843 | 0.058 |
| | 0.08169 | 1.4505 | 0.056 |
| | 0.09357 | 1.60606 | 0.058 |
| | 0.09422 | 1.57544 | 0.060 |
| | 0.08919 | 1.57337 | 0.057 |
| Mean value | 0.089 | 1.54 | 0.058 |
| Belt E | 0.05302 | 1.3754 | 0.039 |
| | 0.05272 | 1.39896 | 0.038 |
| | 0.04266 | 1.3659 | 0.031 |
| | 0.04483 | 1.38436 | 0.032 |
| | 0.04809 | 1.40119 | 0.034 |
| Mean value | 0.048 | 1.39 | 0.035 |

Each of the four structuring belts A, C, D and E was used in a tissue papermaking machine configured according to the embodiment shown in FIG. 1. The machine was run at a speed of 1200 m/min and the manufactured creped and reeled web had a grammage of 20 $g/m^2$. In each case the formed fibre web 1' had a dryness of about 16% before the suction roll 25 and a dryness of about 25% after the suction roll 25. The main press 11 was a shoe press in which the press element 13 comprised a press shoe and an endless impermeable grooved belt which ran about the press shoe in contact with the rear side of the felt. The press nip was thus in this case an extended press nip. The specific pressure in the press nip was 4 MPa. The press felt used was supplied by Albany International and had a grammage of 1425 $g/cm^2$. It had a thickness of about 2.4 mm in an unloaded state and an elastic compressibility which allowed the felt to be compressed in a roll press nip with a peak pressure of 7.3 MPa to a thickness of about 1.7 mm calculated at the middle of the roll press nip, where the load was greatest, and then resume its full thickness when the load ceases at the outlet end of the press nip. Each fibre web 1" structured in this way was then transferred to the Yankee cylinder for drying and was creped by being scraped off the cylinder surface by means of the creping doctor 21. The dryness of the web was measured immediately after the transfer roll 16, and the finished reeled paper web, which was wound on a reel-up, was examined with respect to bulk, tensile strength and elongation. The dryness of the structured fibre web 1" before the drying as above and the thickness of the finished reeled paper web are shown in Table 2 below.

TABLE 2

| Belt | $\frac{a}{d}$ | Dryness % | Thickness µm | Bulk $cm^3/g$ |
|---|---|---|---|---|
| Belt A | 19.6 | 32 | ≈230 | 11.5 |
| Belt C | 37.7 | 45 | ≈250 | 12.5 |
| Belt D | 26.6 | 31 | ≈220 | 11.0 |
| Belt E | 39.7 | 43 | ≈210 | 10.5 |

The results obtained show, surprisingly, that Belt C and Belt E, both having their area a and mean depth d adapted to each other in accordance with the present invention, result in a fibre web with very high dryness after the press nip, and that Belt A and Belt D, which did not have their area a and mean depth d adapted to each other in accordance with the present invention, result in a fibre web with substantially lower dryness after the press nip. The surprising results also show that the structuring belt resulting in a fibre web with the highest dryness, namely Belt C, also has the highest bulk. The higher bulk is due to the coarser structure of Belt C. The bulk obtained with Belt E is also acceptable. It is generally the case that a coarser belt structure results in higher bulk but lower softness, and conversely that a fine structure results in lower bulk but higher softness. Belt C and Belt E thus achieve the aim of reducing energy consumption essentially in the drying section.

Figure 13:
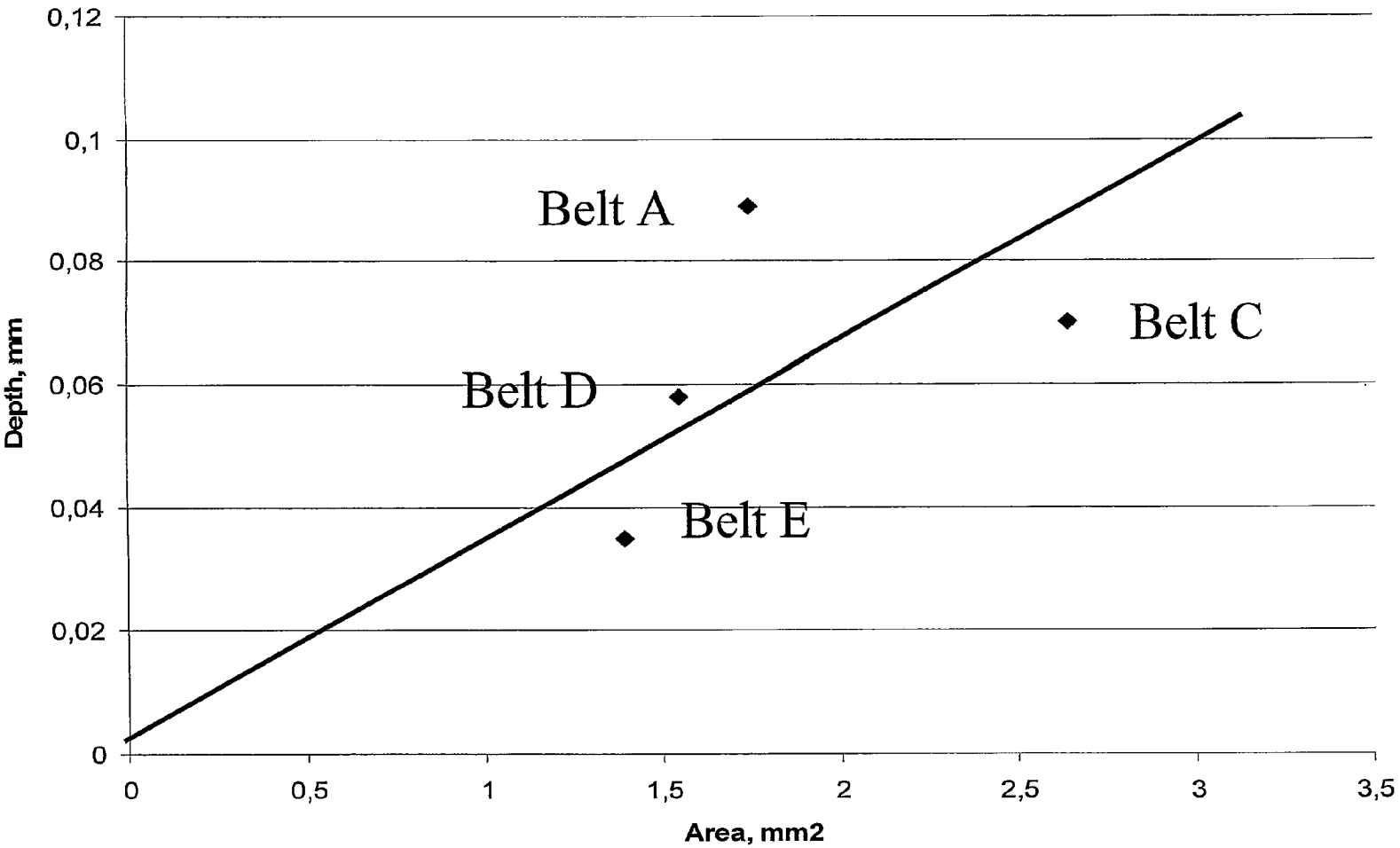
FIG. 13 shows a structuring clothing according to a third embodiment of the invention.

The results obtained were plotted in a coordinate system in which the mean depth d is a function of the area a, as illustrated in the diagram in FIG. 13. The a/d coordinates for the four structuring belts have been marked and give a straight line L through the origin with a slope coefficient k of 30. The region below this line L and within the defined ranges of the area a and mean depth d represents structuring belts falling within the scope of the present invention and resulting in fibre webs with high dryness and satisfactory structures, whereas this is not the case in the region above the line L as is shown in the comparative tests presented herein.

A tissue papermaking machine with structuring clothing according to the present invention enables manufacturing of creped reeled tissue paper with the following characteristics:

| | |
|---|---|
| Grammage | 10-50 $g/m^2$ |
| Thickness | 160-400 µm |
| Bulk | 8-20 $cm^3/g$ |
| MD tensile strength | 50-300 N/m |
| CD tensile strength | 30-300 N/m |

The structuring clothing can be manufactured by forming a carrying layer 59 and a structured layer 60, which is to contact the fibre web l' and is supported by the carrying layer 59. The structured layer 60 has a three-dimensional woven structure formed of elevations 62 and depressions 63 which are defined by the elevations 62, said elevations 62, like the depressions 63, being repeated and distributed in the longitudinal and transverse directions of the structuring clothing to form a pattern of polygonal, geometrically similar, smallest unitary surfaces 64 which are located adjacent each other and have common boundary lines. Each smallest unitary surface 64 has an area a and covers a plurality of depressions 63 with the mean depth d. The position and the alignment of each smallest unitary surface 64 are defined by the fact that the corners thereof are coinciding with elevations 62 which are displaced in relation to each other and formed by four consecutive longitudinal threads so that the area a and the mean depth d of each smallest unitary surface 64 are adapted in relation to each other in such a way that, calculated by the length unit mm, their a/d ratio is equal to or greater than 30 mm, wherein a is selected within the range of 1.0-3.0 $mm^2$ and d is selected within the range of 0.03-0.09 mm. A coating in form of a liquid polymer is applied onto the side of the fabric that then is to form the structuring layer 60 and is to contact the fibre web.

The expression "a plurality of depressions" covers not only such a depression which is located entirely within one and the same unitary surface but also a depression which comprises a portion located within a first unitary surface and another portion located within an adjacent second unitary surface. It is understood that in measuring each such a unitary surface also each portion of a depression related to this unitary surface is measured.

The expression "smallest unitary surfaces" means that all smallest unitary surfaces of one and the same structuring clothing have the same topography with respect to the underlying bottom surface, i.e. the same distribution and location or orientation of elevations 62 and depressions 63 which recur as repeating patterns in the structured layer.

The invention also relates to a method of rebuilding of a conventional tissue papermaking machine comprising a press section with first and second clothings, wherein the first clothing is an elastic, compressible press felt, by replacing the second clothing of the press section with a structuring belt according to any one of the claims 1 to 7.

The invention claimed is:

1. A structuring clothing for structuring a wet fibre web in a press process in a press section of a tissue papermaking machine, said structuring clothing comprising a carrying layer and a structured layer which contacts the fibre web and is supported by the carrying layer, said structured layer having a three-dimensional woven structure comprising longitudinal and transverse threads plaited into each other and forming elevations and depressions which are defined by the elevations, said elevations, like the depressions, are repeated and distributed in the longitudinal and transverse directions of the structuring clothing to form a pattern of polygonal, geometrically similar smallest unitary surfaces which are located adjacent each other and have common boundary lines, each of said smallest unitary surfaces having an area a and covering more depressions with the mean depth d, wherein the position and the alignment of each smallest unitary surface are defined by the fact that the corners thereof are coinciding with elevations which are displaced in relation to each other and formed by four consecutive longitudinal threads, characterised in that wherein the area a and the mean depth d of each smallest unitary surface of the structured layer are adapted in relation to each other in such a way that, calculated by the length unit mm, their a/d ratio is equal to or greater than 30 mm, wherein a is selected within the range of 1.0-3.0 $mm^2$ and d is selected within the range of 0.03-0.09 mm.

2. The structuring clothing according to claim 1, wherein the area a is selected within the range of 1.3-2.6 $mm^2$.

3. The structuring clothing according to claim 1, wherein the smallest unitary surfaces are tetragonal, wherein the position and alignment of each unitary surface are defined by the fact that the corners thereof are coinciding with four adjacent elevations displaced in relation to each other and formed by four consecutive, longitudinal threads.

4. The structuring clothing according to claim 1, wherein the structured layer has a coating on the side which is to contact the fibre web, said coating being formed by applying a polymer onto the plaited threads, and that the carrying layer is joined to the structured layer to form a unit.

5. The structuring clothing according to claim 4, wherein the structured layer has threads plaited in each other and distributed in a first group of longitudinal threads and a second group of transverse threads to form said elevations and depressions, wherein the elevations have longitudinal and transverse knuckles, said knuckles of two neighbouring threads in the respective groups are displaced in relation to each other, wherein said unitary surface is a parallelogram with its corners located at the midpoints of the longitudinal knuckles of four neighbouring and successive longitudinal threads.

6. The structuring clothing according to claim 1, wherein it is impermeable.

7. The structuring clothing according to claim 1, wherein it is water permeable.

8. A tissue papermaking machine for manufacturing a structured creped tissue paper web, comprising a wet section for forming a fibre web comprising
- a headbox,
- a forming roll and
- a first clothing running about and in contact with the forming roll, a press section comprising
- a main press comprising
  - a first press element,
  - a second press element, said press elements defining a press nip therebetween with a predetermined pressure,
  - a first clothing in form of an elastic compressible press felt running in an endless loop around a plurality of guide rolls and through said press nip together and in contact with the formed fibre web, the second press element being disposed within the loop of the press felt,
  - a second clothing which runs in an endless loop around a plurality of guide rolls and through said press nip together and in contact with the formed fibre web, the first press element being disposed within the loop of the second clothing, and
  - a transfer roll disposed within the loop of the second clothing, a drying section for final drying of the pressed fibre web, which comprises
- a drying surface for drying the fibre web, and a creping doctor for creping the web from the drying surface so that a creped tissue paper web is taken off from the drying surface, said transfer roll being arranged to form together with the drying surface a transfer nip for transferring the fibre web to the drying surface without compression in the transfer nip, wherein the second clothing is a structuring clothing according to claim 1, said structuring clothing being arranged to effect a structuring of the formed fibre web in said press nip so that a structured fibre web is leaving the press nip.

9. The tissue papermaking machine according to claim 8, wherein the press felt being arranged, at said predetermined pressure, to elastically reconfiguring itself in accordance with the structured layer of the structuring clothing so that the formed fibre web entirely penetrates into the depressions and so that a structured fibre web leaves the press nip with a dryness of more than 38%, and a structured tissue paper web leaves the drying section in creped form with a bulk of 8-20 $cm^3/g$.

10. The tissue papermaking machine according to claim 8, wherein the drying surface consists of the envelope surface of a drying cylinder.

11. The tissue papermaking machine according to claim 8, wherein the wet section comprises a dewatering device for increasing the dryness of the fibre web to 16 to 25%.

12. The tissue papermaking machine according to claim 11, wherein the dewatering device comprises a suction roll disposed in the loop of the first forming clothing downstream of the forming roll, and a steam box disposed on the outside of the loop of the forming clothing opposite said suction roll.

13. The tissue papermaking machine according to claim 11, wherein the loop of the structuring clothing extends between the main press and the transfer roll and that the loop of the press felt of the main press extends between the forming roll and the main press, wherein the press felt of the main press also constitutes said first forming clothing.

14. The tissue papermaking machine according to claim 8, wherein the main press is a press with an extended press nip, and the second press element of the press comprises a device for defining the extended press nip for cooperation with the first press element.

15. The tissue papermaking machine according to claim 14, wherein the main press is a shoe press and that the device for defining the extended press nip comprises a press shoe and an endless belt which runs through the extended press nip, wherein the press shoe is arranged to press against the inside of the belt.

16. The tissue papermaking machine according to claim 14, wherein the device for defining the extended press nip comprises an elastic support body arranged to pressing in the direction to the first press element.

17. The tissue papermaking machine according to claim 8, wherein the press section also comprises a pre-press comprising a first press element and a second press element, said press elements, defining a press nip therebetween, a press felt running in an endless loop around a plurality of guide rolls and through said press nip together with the press felt of the main press, the second press element being disposed within the loop of the press felt of the pre-press and the first press element being disposed within the loop of the press felt of the main press, and wherein the formed fibre web runs through the press nip of the pre-press enclosed between the two press felts.

18. The tissue papermaking machine according to claim 17, wherein the pre-press comprises a press with an extended nip.

19. The tissue papermaking machine according to claim 17, wherein the structuring clothing extends between the main press and the transfer roll, that the press felt extends between the pre-press and the main press, and that said first forming clothing extends between the forming roll and the pre-press and constitutes the press felt of the pre-press.

20. The tissue papermaking machine according to claim 17, wherein the structuring clothing extends between the main press and the transfer roll, that the press felt extends between the pre-press and the main press, that the press felt of the pre-press extends between a transfer zone and the pre-press and that the loop of the forming clothing extends between the forming roll and a guide roll disposed in connection to said transfer zone.

21. The tissue papermaking machine according to claim 8, wherein the loop of the structuring clothing extends between the forming roll and the transfer roll to also constitute said first forming clothing.

22. The tissue papermaking machine according claim 8, wherein a pre-heating device is disposed downstream of the main press.

23. A press section for manufacturing a structured fibre web and adapted to a tissue papermaking machine for manufacturing a creped tissue paper web with high bulk, said press section comprising a main press comprising
- a first press element,
- a second press element, said press elements defining a press nip therebetween with a predetermined pressure,
- a first clothing in form of an elastic compressible press felt running in an endless loop around a plurality of guide rolls and through said press nip together and in contact with the formed fibre web, the second press element being disposed within the loop of the press felt, a second clothing running in an endless loop around a plurality of guide rolls and through said press nip together and in contact with the formed fibre web, the first press element being disposed within the loop of the second clothing, wherein the second clothing is a structuring clothing according to claim 1, said structuring clothing being arranged to effect a structuring of the formed fibre web in said press nip so that a structured fibre web is leaving the press nip.

24. The press section according to claim 23, wherein the press felt is arranged, at said predetermined pressure, to elastically reconfiguring itself in accordance with the structured layer of the structuring clothing so that the formed fibre web entirely penetrates into the depressions and so that a structured fibre web leaves the press nip with a dryness of more than 38%.

25. The press section according to claim 24, wherein said dryness is between 38 and 52%.

26. The press section according to claim 23, wherein the main press is a press with an extended press nip, and the second press element of the press comprises a device for defining the extended press nip for cooperation with the first press element.

27. The press section according to claim 26, wherein the main press is a shoe press and that the device for defining the extended press nip comprises a press shoe and an endless belt running through the extended press nip, wherein the press shoe is arranged to press against the inside of the belt.

28. The press section according to claim 26, wherein the device for defining the extended press nip comprises an elastic support body arranged to press in the direction towards the first press element.

29. A method of manufacturing a creped tissue paper web with high bulk in a tissue papermaking machine, said method comprising forming a fibre web in a wet section which comprises a headbox, a forming roll and a first clothing running about and in contact with the forming roll, pressing the formed fibre web in a press section which comprises a main press comprising a first press element, a second press element, said press elements defining a press nip therebetween with a predetermined pressure, a first clothing in form of a press felt running in an endless loop around a plurality of guide rolls and through said press nip together and in contact with the formed fibre web, the second press element being disposed within the loop of the press felt, a second clothing running in an endless loop around a plurality of guide rolls and through said press nip together and in contact with the formed fibre web, the first press element being disposed within the loop of the second clothing, and a transfer roll disposed within the loop of the second clothing, drying the structured fibre web in a drying section comprising a drying surface, and creping the dried fibre web from the drying surface with a creping doctor so that a creped tissue paper web is taken off from the drying surface, said transfer roll being arranged to define together with the drying surface a transfer nip for transferring the structured fibre web to the drying surface without compression in the transfer nip, wherein the pressing and structuring of the formed wet fibre web are carried out while using said second clothing which is in form of a structuring clothing to provide a three-dimensional, structured fibre web in the press step in the press nip, said structuring clothing having a carrying layer and a structured layer, which is to contact the fibre web and is supported by the carrying layer, said structured layer having a three-dimensional woven structure comprising longitudinal and transverse threads plaited into each other and forming elevations and depressions which are defined by the elevations, said elevations, like the depressions, are repeated and distributed in the longitudinal and transverse directions of the structuring clothing to form a pattern of polygonal, geometrically similar smallest unitary surfaces which are located adjacent each other and have common boundary lines, each of said smallest unitary surfaces having an area a and covering a plurality of depressions with the mean depth d, wherein the position and the alignment of each smallest unitary surface are defined by the fact that the corners thereof are coinciding with elevations which are displaced in relation to each other and formed by four consecutive longitudinal threads, wherein the area a and the mean depth d of each smallest unitary surface of the structured layer are adapted in relation to each other in such a way that, calculated by the length unit mm, their a/d ratio is equal to or greater than 30 mm, wherein a is selected within the range of 1.0-3.0 $mm^2$ and d is selected within the range of 0.03-0.09 mm.

30. The method of claim 29, wherein the press felt is brought, at said predetermined pressure, to elastically reconfigure itself in accordance with the structured layer of the structuring clothing in order to maintain a necessary hydraulic pressure in the depressions so that the formed fibre web entirely penetrates into the depressions and so that a structured fibre web leaves the press nip with a dryness of more than 38% and a structured tissue paper web leaves the drying section in creped form with a bulk of 8-20 $cm^3/g$.

31. The method according to claim 29, wherein the dryness of the formed fibre web is further increased before the main press by means of a press-free and TAD-free dewatering device.

32. The method according to claim 31, characterised in that the dryness of the formed fibre web is increased before the main press by means of a pre-press.

33. The method according to claim 29, wherein the structured fibre web is preheated before it reaches the drying cylinder.

34. The method according to claim 29, wherein the fibre web is formed on the structuring clothing, which runs in an endless loop about the forming roll and the transfer roll, wherein the structuring clothing carries the formed fibre web all the way up to the main press.

35. The method according to claim 29, wherein a creped tissue paper web is manufactured which before reeling has the following characteristics:

Grammage 10-50 $g/m^2$

Thickness 160-400 μm Bulk 8-20 $cm^3/g$

MD tensile strength 50-300 N/m

CD tensile strength 30-300 N/m.

36. A creped tissue paper manufactured by the method according to claim 29.

37. A method of rebuilding a tissue papermaking machine comprising a press section for manufacturing a creped tissue paper web with high bulk, wherein the second clothing of the press section is replaced by a structuring clothing according to claim 1.

* * * * *